US005532103A

United States Patent [19]

Markovics et al.

[11] Patent Number: 5,532,103

[45] Date of Patent: Jul. 2, 1996

[54] MULTILAYER ELECTROPHOTOGRAPHIC IMAGING MEMBER

[75] Inventors: James M. Markovics, Rochester; Richard H. Nealey, Penfield, both of N.Y.

[73] Assignee: Xerox Corporation, Stamford, Conn.

[21] Appl. No.: 195,427

[22] Filed: Feb. 14, 1994

Related U.S. Application Data

[63] Continuation-in-part of Ser. No. 932,150, Aug. 19, 1992.

[51] Int. Cl.[6] ..... G03G 5/043

[52] U.S. Cl. ..... 430/131; 430/132

[58] Field of Search ..... 430/58, 59, 66, 430/67, 131, 132

[56] References Cited

U.S. PATENT DOCUMENTS

| | | | |
|---|---|---|---|
| 4,082,551 | 4/1978 | Steklenski et al. | 96/1 PC |
| 4,088,485 | 5/1978 | Ing et al. | 96/1.5 |
| 4,233,384 | 11/1980 | Turner et al. | 430/59 |
| 4,252,883 | 2/1981 | Komura et al. | 430/132 |
| 4,265,990 | 5/1981 | Stoka et al. | 430/59 |
| 4,306,008 | 12/1981 | Pai et al. | 96/1 PC |
| 4,481,273 | 11/1984 | Katagiri et al. | 430/59 |
| 4,521,457 | 6/1985 | Russell et al. | 427/286 |
| 4,535,042 | 8/1985 | Kitayana et al. | 430/58 |
| 4,571,371 | 2/1986 | Yashiki | 430/62 |
| 4,579,801 | 4/1986 | Yashiki | 430/60 |
| 4,618,559 | 10/1986 | Yashiki | 430/127 |
| 4,652,507 | 3/1987 | Dossel et al. | 430/57 |
| 5,008,171 | 4/1991 | Yamazaki | 430/67 |
| 5,096,793 | 3/1992 | Osawa et al. | 430/58 |
| 5,154,996 | 10/1992 | Makino et al. | 430/58 |
| 5,200,286 | 4/1993 | Yashiki et al. | 430/58 |
| 5,213,937 | 5/1993 | Miyake | 430/130 |

FOREIGN PATENT DOCUMENTS

| | | |
|---|---|---|
| 185769 | 7/1991 | Japan . |
| 5034955 | 2/1993 | Japan . |
| 91-17485 | 11/1991 | WIPO . |

*Primary Examiner*—John Goodrow
*Attorney, Agent, or Firm*—Oliff & Berridge

[57] ABSTRACT

An electrophotographic imaging member includes a charge generating layer, a charge transport layer and an interphase region. The interphase region includes a mixture of a charge generating material and a charge transport material, in intimate contact, and may be formed, for example, by applying a charge transport material prior to drying or curing an underlying charge generating layer to produce an interphase structure that is different from the charge generating and charge transport layers.

21 Claims, 2 Drawing Sheets

MULTILAYER ELECTROPHOTOGRAPHIC IMAGING MEMBER

This application is a continuation-in-part of pending U.S. application Ser. No. 07/932,150 filed Aug. 19, 1992.

FIELD OF THE INVENTION

The present invention relates to electrophotography, more specifically, to electrophotographic imaging members having charge generating layers and charge transport layers.

BACKGROUND OF THE INVENTION

In electrophotography, an electrophotographic imaging member containing a photoconductive insulating layer on a conductive layer is imaged by first uniformly, electrostatically charging its surface. The member is then exposed to a pattern of activating electromagnetic radiation, such as light. The radiation selectively dissipates the charge in the illuminated area of the photoconductive insulating layer while leaving behind an electrostatic pattern in the non-illuminated area. A latent image may then result from either the charge-dissipated illuminated area or the charged, non-illuminated area. This electrostatic latent image may then be developed to form a visible image by depositing finely divided toner particles on the surface of the photoconductive insulating layer. The resulting visible image may then be transferred from the electrophotographic member to a support such as paper. This imaging process may be repeated many times with reusable photoconductive insulating layers.

An electrophotographic imaging member may exist in a number of forms. For example, the imaging member may be a homogeneous layer of a single material or may be a composite of more than one distinct layer. An example of a multilayered electrophotographic imaging member may comprise a substrate, a conductive layer, a blocking layer, an adhesive layer, a charge generating layer and a charge transport layer. U.S. Pat. Nos. 4,265,990, 4,233,384 and 4,306,008 disclose examples of photosensitive members having at least two electrically operative layers, including a charge generating layer and a charge transport layer.

In multilayered imaging members, materials used for each layer preferably have desirable mechanical properties while also providing electrical properties necessary for the function of the device. If the material of one layer of the imaging device is changed in an attempt to improve a particular property, e.g., an electrical property, the change may have an adverse effect on mechanical properties such as delamination of one or more layers.

In a multi-layered electrophotographic imaging member having, inter alia, a charge generating layer and a charge transport layer, the photosensitivity of this electrophotographic imaging member depends on: 1) both the efficiency of conversion of absorbed photons into charge carriers (photogeneration efficiency of a charge generating material); and 2) the injection of those charges into the charge transport layer. If charge injection of the absorbed photons into the charge transport layer is limited, photosensitivity of the electrophotographic imaging member, measured by the rate of discharge upon exposure, will similarly be limited.

Other difficulties also exist in fabricating electrophotographic imaging members. In seamless imaging members, a conductive metal layer cannot be deposited in an economical manner. Similarly, vacuum coating techniques are expensive when coating seamless substrates. Thus, the use of conductive layers applied by other coating techniques becomes important.

Suitable and economical coating methods used for applying layers in multi-layer electrophotographic imaging members include dip coating, roll coating, Meyer bar coating, bead coating, curtain flow coating and vacuum deposition. These exemplary methods are known in the art. Solution coating is a preferred approach.

U.S. Pat. No. 4,082,551 to Steklenski et al. discloses a process of coating multiple layers onto an insulating, polyester substrate by applying solutions having the coating substance dissolved therein and drying each applied layer before coating a subsequent layer. In this case, the coated elements, when tested, indicate no chemical interaction between the photogenerating and conducting layers and essentially no change in the electrical resistivity of the conducting layer.

U.S. Pat. No. 4,571,371 to Yashiki discloses an electrophotographic photosensitive member having a charge generating layer and a charge transport layer. A dispersion of charge generating material dissolved in solvent was applied to a cured polyamide resin layer by soaking and dried at 100° C. for 10 minutes to form a charge generating layer. Subsequently, a solution containing a charge transfer material was applied to the dried charge generating layer followed by drying at 100° C. for 60 minutes to form a charge transfer layer.

U.S. Pat. No. 4,579,801 to Yashiki discloses a process for applying a dispersion of charge generating material in a solution containing a binder resin to a suitable substrate or dried underlayer. The charge generation layer can be formed by vapor deposition. The disclosure suggests that a charge transporting material, dissolved in a solution of resin, is applied using conventional methods to form a thin film.

U.S. Pat. No. 4,521,457 to Russell et al. discloses a process for simultaneously constraining two different coating materials, and forming on a substrate a continuous, unitary layer comprising adjacent "ribbons," each ribbon comprised of different materials and in edge-to-edge contact with an adjacent ribbon. The coated ribbons, thus applied, were dried in two zones, one at about 57° C. and another at about 135° C. Although the process is suitable for a number of applications, it is said to be particularly useful for producing electrophotographic imaging members utilizing multi-active layers.

Conventional electrophotographic imaging members, having at least a charge generating layer and a charge transport layer and made according to the above processes, suffer numerous disadvantages. For example, as discussed above, some electrophotographic imaging members suffer from poor charge acceptance and have limited photosensitivity due to limited injection of absorbed photons into the charge transport layer. In addition, charge transport materials may diffuse and come in contact with the conductive layer, adversely affecting the electrophotographic imaging member. Notably, devices manufactured using conventional processes have limited photoresponse.

SUMMARY OF THE INVENTION

The present invention is directed to electrophotographic imaging members having markedly improved photoresponse as compared with conventional devices. Specifically, an electrophotographic imaging member according to the present invention comprises a charge generating layer, a charge transport layer and an interphase region. The present invention provides electrophotographic imaging members which enhance the injection of photogenerated charge into the charge transport layer. The interphase region comprises charge generating material and charge transport material. In one process according to the present invention, charge transport material migrates across a charge transport/charge generating interface into the charge generating material.

The invention may be more fully understood with reference to the accompanying drawings and the following description of preferred embodiments illustrated in the drawings. The invention is not limited to the exemplary embodiments but should be recognized as contemplating all modifications within the skill of an ordinary artisan.

DETAILED DESCRIPTION OF PREFERRED EMBODIMENTS

A representative electrophotographic imaging member may include a supporting substrate, optional adhesive layer(s), a conductive layer, a blocking layer, a charge generating layer, an interphase region and a charge transport layer. Other combinations of layers suitable for use in electrophotographic imaging members are also within the scope of the invention. For example, an anti-curl backing layer and/or a protective overcoat layer may also be included, and/or the substrate and conductive layer may be combined. Additionally, a ground strip may be provided adjacent the charge transport layer at an outer edge of the imaging member. The ground strip is coated adjacent to the charge transport layer so as to provide grounding contact with a grounding device.

The substrate, conductive layer, blocking layer and adhesive layer(s), if incorporated into an electrophotographic imaging member according to the present invention, may be prepared and applied using conventional materials and methods.

An electrophotographic imaging member according to the present invention comprises a charge generating layer, a charge transport layer and an interphase region between the charge generating layer and the charge transport layer. The interphase region contains a mixture of charge transport material and charge generating material.

In one embodiment, the interphase region is formed by applying a charge transport material to an underlying layer of charge generating material, prior to drying or curing the underlying layer.

Application of charge transport material before the underlying layer has completely dried or cured can produce the interphase region comprising a mixture of the charge generating material and the charge transport material. This method permits the charge transport material and/or the charge generating material to migrate across the charge transport layer/charge generating layer interface to form the interphase region, thereby increasing the photosensitivity of the resulting imaging member. Such an interphase region can have the charge generating material and the charge transport material mixed on a molecular level.

The interphase region, preferably having the charge transport material in an increasing gradient in a direction approaching the charge transport layer on a molecular level may enhance the injection of photogenerated charge from the charge generating material into the charge transport layer by enhancing the charge transport efficiency throughout the charge generating layer.

Figure 1:
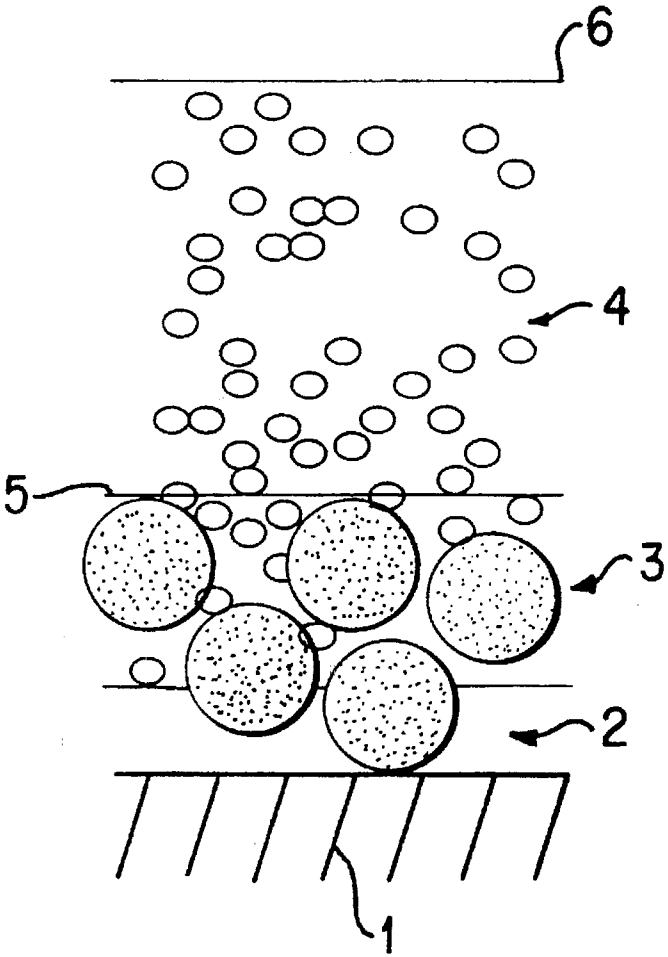
FIG. 1 depicts a molecular level, cross-sectional microstructure of an electrophotographic imaging member according to the invention having a binder-dispersed charge generating layer and a charge transport layer.

A gradual mixing of the charge generating material and the charge transport material in the interphase region between the charge generating layer and the charge transport layer can be achieved by diffusion of the charge transport material into solvent-rich, undried charge generating layer during the coating process. This gradient transition of the interphase region is illustrated by the example shown in FIG. 1. FIG. 1 shows a charge generating layer 2 which is free of charge transport material applied to a substrate 1. Before the layer 2 is dried a charge transport layer 4, which is free of charge generating material and contains a charge transport material capable of migrating across the charge generating layer/charge transport layer interface 5, is applied to the imaging member. The cross-section in FIG. 1 illustrates the effect of the migration of charge transport material into the undried charge generating material resulting in the gradient interphase region 3. The gradient transition between the charge generating layer and the charge transport layer significantly enhances the photoresponse of the electrophotographic imaging member and provides remarkably improved performance over imaging members produced using conventional means. The mixture in the interphase region is preferably characterized by a decreasing gradient of charge generating material and an increasing gradient of charge transport material in the direction of the charge transport layer of the electrophotographic imaging member 6. In another related embodiment, the charge transport layer could contain a minor amount (relative to the charge transport material) of a charge generating material, and/or the charge generating layer could contain a minor amount (relative to the charge generating material) of a charge transport material.

Figure 2:
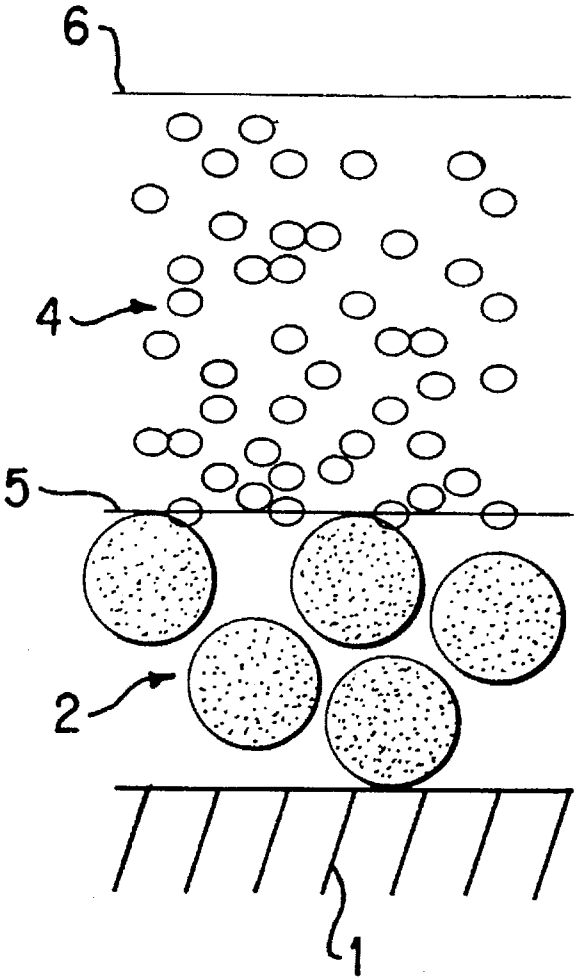
FIG. 2 depicts a molecular level cross-sectional microstructure of an electrophotographic imaging member having a binder-dispersed charge generating layer and a charge transport layer prepared using conventional techniques.

FIG. 2 represents an electrophotographic imaging member as in FIG. 1 except that the underlying charge generating layer is dried. No interphase region is achieved using this conventional method.

Figure 3:
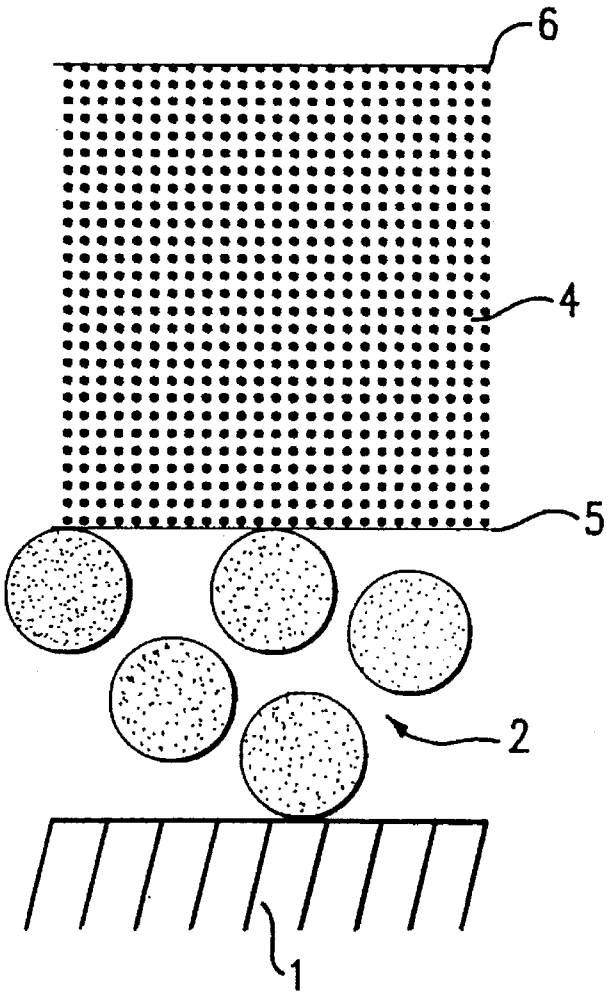
FIG. 3 depicts a molecular level cross-sectional microstructure of an electrophotographic imaging member having a binder-dispersed charge generating layer and a charge transport layer without a migrating charge transport material.

FIG. 3 illustrates an active binder charge transport layer 4 in which a charge transport material, not containing a component capable of migrating across the charge generating layer/charge transport layer interface 5, is applied to an undried charge generating layer. This does not provide the interphase region of the invention.

The composition of the interphase region may be directly controlled by the specific type of process used to apply the underlying charge generating layer and the charge transport layer. For example, a method for simultaneously applying the charge generating material and the charge transport material controls the concentration of the charge generating material and the charge transport material at various depths in the interphase region. Specifically, a spraying apparatus fed by two reservoirs respectively containing charge generating material and charge transporting material may be passed over a suitable substrate several times. The amount of charge generating material may be decreased and the amount of charge transport material increased so that, with each successive pass, a gradual transition from charge generating material to charge transporting material is achieved, thus producing the interphase region gradient.

Generally, the cumulative thickness of the layers in a multilayered electrophotographic imaging member does not exceed 30 micrometers. Therefore, preferred interphase region thicknesses range from about 0.1 micrometer to about 10 micrometers.

Any suitable charge generating material may be applied to a substrate or other layer. The charge generating materials for use in the present invention are preferably compositions comprising a photogenerating pigment. More preferably, the photogenerating pigment is dispersed in a film-forming binder and the resulting dispersion is dissolved in a solvent for application of the charge generating layer.

Examples of photogenerating pigments include, but are not limited to, inorganic photoconductive particles such as amorphous silicon, selenium, trigonal selenium, selenium alloys, phthalocyanine pigment, metal phthalocyanines, metal-free phthalocyanines, dibromoanthanthrones, squarylium, quinacridones, benzimidazole perylene, substituted diamino triazines, polynuclear aromatic quinones, and the like. If desired, other suitable, known photogenerating materials may be utilized.

Preferred selenium alloys include, but are not limited to, selenium-tellurium, selenium-tellurium-arsenic and selenium arsenide; preferred metal phthalocyanines include, but are not limited to, vanadyl phthalocyanine, titanyl phthalocyanine and copper phthalocyanine; preferred dibromoanthanthrones include, but are not limited to, products available from du Pont under the tradenames Monastral Red, Monastral Violet and Monastral Red Y, Vat orange 1 and Vat orange 3. Preferred polynuclear aromatic quinones include, but are not limited to, products available from Allied Chemical Corporation under the tradenames. Indofast Double Scarlet, Indofast Violet Lake B, Indofast Brilliant Scarlet and Indofast Orange.

Charge generating layers comprising a photoconductive material such as amorphous silicon, vanadyl phthalocyanine, metal free phthalocyanine, benzimidazole perylene, amorphous selenium, trigonal selenium, selenium alloys such as selenium-tellurium, selenium-telluriumarsenic, selenium arsenide, and the like and mixtures thereof, are preferred because of their sensitivity to visible light. Vanadyl phthalocyanine, metal free phthalocyanine and selenium alloys are preferred because these materials are also sensitive to infrared light.

Any suitable polymeric film-forming binder material may be employed as a matrix in the charge generating layer. The binder polymer preferably 1) adheres well to the substrate or other underlying layer; and 2) dissolves in a solvent. Examples of materials useful as the film-forming binder include, but are not limited to, polyvinylcarbazole, phenoxy resin, polycarbonate, polyvinylbutyral, polystyrene, polystyrenebutadiene and polyester.

Solvents used for the charge generating compositions of the invention should dissolve the film-forming binder of the charge generating layer and be capable of dispersing the photogenerating pigment particles present in the charge generating composition. Examples of typical solvents include, but are not limited to, monochlorobenzene, tetrahydrofuran, cyclohexanone, methylene chloride, 1,1,1-trichloroethane, 1,1,2-trichloroethane, dichloroethylene, 1,2-dichloroethane, toluene, and the like, and mixtures thereof. Mixtures of solvents may be utilized to control evaporation rate. For example, satisfactory results may be achieved with a tetrahydrofuran to toluene ratio of between about 90:10 and about 10:90 by weight.

Preferably, the combination of photogenerating pigment, binder polymer and solvent should form uniform dispersions of the photogenerating pigment in the charge generating composition. Examples of charge generating layer compositions include, but are not limited to, benzimidazole perylene, polycarbonate and methylene chloride; polyvinylbutyral, titanyl phthalocyanine and tetrahydrofuran; phenoxy resin, copper phthalocyanine and toluene; and polycarbonate resin, vanadyl phthalocyanine and methylene chloride.

Generally, from about 5 percent by volume to about 95 percent by volume of the photogenerating pigment is dispersed in no more than about 95 percent by volume of the film-forming binder. In one embodiment, a volume ratio of the photogenerating pigment and film-forming binder is about 1:12, corresponding to about 8 percent by volume of the photogenerating pigment dispersed in about 92 percent by volume of the film-forming binder. In another embodiment, the volume ratio of the film-forming binder and photogenerating pigment is about 1:9 corresponding to about 90 percent of the photogenerating pigment dispersed in about 10 percent binder.

Exemplary charge generating layer thicknesses according to the present invention include, but are not limited to, thicknesses ranging from about 0.1 micrometer to about 5.0 micrometers, and preferably from about 0.3 micrometer to about 3 micrometers. Charge generating layer thickness generally depends on film-forming binder content. Higher binder content generally results in thicker layers for photogeneration. Thicknesses outside the above exemplary ranges are also within the scope of the invention.

The charge transport layer comprises any suitable organic polymer or non-polymeric material capable of transporting charge to selectively discharge the surface charge. The charge transport layer is preferably transparent. It may not only serve to transport charges, but may also protect the imaging member from abrasion, chemical attack and similar destructive elements, thus extending the operating life of the electrophotographic imaging member. Alternatively, or in addition, a protective overcoat layer may provide these protective functions.

The charge transport layer should exhibit negligible, if any, discharge when exposed to a wavelength of light useful in xerography, e.g. 4000 Angstroms to 9000 Angstroms. Therefore, the charge transport layer is substantially transparent to radiation in a region in which the photoreceptor operates.

Charge transport materials for use in the present invention are preferably compositions comprising a hole transporting material dispersed in a resin binder and dissolved in a solvent for application.

Hole transporting materials for use in compositions according to the present invention include, but are not limited to, a mixture of one or more transporting aromatic amines. Exemplary aromatic amines include triaryl amines such as triphenyl amines, poly triaryl amines, bisarylamine ethers and bisalkylaryl amines.

Preferred bisarylamine ethers include, but are not limited to, bis(4-diethylamine-2-methylphenyl)phenylmethane and 4'-4"-bis(diethyl-amino)- 2',2"-dimethyltriphenylmethane. Preferred bisalkylaryl amines include, but are not limited to, N,N'-bis(alkylphenyl)-(1,1'-biphenyl)-4,4'-diamine wherein the alkyl is, for example, methyl, ethyl, propyl, n-butyl, and the like. Meta-tolyl-bis-diphenylamino benzadine and N,N'-diphenyl-N,N'-bis(3"- methylphenyl)-(1,1' biphenyl)-4,4'-diamine are preferred transporting aromatic amines.

Exemplary resin binders used in charge transport compositions according to the present invention include, but are not limited to, polycarbonate, polyvinylcarbazole, polyester, polyarylate, polyacrylate, polyether and polysulfone. Molecular weights of the resin binders can vary from about 20,000 to about 1,500,000.

Preferred resin materials are polycarbonate resins having molecular weights from about 20,000 to about 120,000, more preferably from about 50,000 to about 100,000. Highly preferred resin materials are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; polycarbonate resin having a molecular weight of from about 50,000 to about 100,000, available as Makrolon from Farben Fabricken Bayer A. G.; polycarbonate resin having a molecular weight of from about 20,000 to about 50,000 available as Merlon from Mobay Chemical Company; polyether carbonates; and 4,4'-cyclohexylidene diphenyl polycarbonate.

Solvents useful to form charge transport layers according to the present invention include, but are not limited to, monochlorobenzene, tetrahydrofuran, cyclohexanone, methylene chloride, 1,1,1-trichloroethane, 1,1,2-trichloroethane, dichloroethylene, toluene, and the like. Methylene chloride is a desirable component of the charge transport layer coating mixture for adequate dissolving of all the components and for its low boiling point.

An especially preferred charge transport layer material for multilayer photoconductors comprises from about 25 percent to about 75 percent by weight of at least one charge transporting aromatic amine, and about 75 percent to about 25 percent by weight of a polymeric film-forming resin in which the aromatic amine is soluble.

As discussed above, an exemplary mechanism for mixing charge generating material and charge transport material to form an interphase region 7 according to the present invention, molecular mixing in which charge transport material migrates across the charge generating material/charge transport material interface to achieve a gradient of charge transport material in the interphase region, and combinations of this and other mechanisms. Combinations of charge generating material and charge transport material in an electrophotographic imaging member according to the present invention preferably include materials which are capable of molecular mixing.

In a process of the invention for producing the electrophotographic imaging member having an interphase region, a charge generating layer is applied to form an underlying layer; the underlying layer is overcoated, prior to drying, with a charge transport material to form a charge transport layer; the charge transport material is allowed to diffuse into the undried underlying layer; and the underlying layer and charge transport layer are dried or cured to fix the interphase region having a mixture of a charge generating material and a charge transport material. Another exemplary process according to the invention which permits control of the concentration of the charge generating material and charge transport material in the interphase region includes simultaneously applying the charge generating material and charge transport material and decreasing the amount of the charge generating material while increasing an amount of the charge transport material.

Any suitable technique, which has been appropriately selected and/or modified in accordance with the process herein described, may be utilized to mix and thereafter apply any of the charge generating layer composition, the charge transport layer composition or simultaneously applied charge generating material and charge transport material layer to the substrate or other underlying layer. Typical application techniques include spray coating, dip coating, roll coating, Meyer bar coating, bead coating, curtain flow coating and the like.

Drying of the deposited coating can be carried out by any suitable conventional technique to remove substantially all of the solvent from the applied charge generating layer, charge transport layer or interphase region. Nonlimiting examples of such techniques include oven drying, infrared radiation drying, air drying and the like. When the coating is dried, it may be dried at room temperature or elevated temperature. In the embodiment in which the charge transport layer is applied to the charge generating layer prior to drying, the charge transport layer can be applied immediately after application of the charge generating layer or can be applied to a partially or nearly completely solidified charge generating layer. In the embodiment wherein the charge generating material and charge transport material are simultaneously applied, the materials may be applied to a dried charge generating layer or to a partially or completely dried charge generating layer. Correspondingly, the applied interphase region may be completely or only partially dried prior to application of the charge transporting layer. Each layer can be applied to a previously applied layer in the wet state or in any state including a dry or nearly solidified state.

A previously applied layer may be dried for a period of 0 to 20 minutes or longer before application of the next layer. In various embodiments of the invention, a previously applied layer may be dried for periods of 0 to 20 minutes, 5 to 15 minutes or 10 to 12 minutes. In some embodiments, the previously applied layer can be dried for a period of 0 to 5 minutes or 0 to 10 minutes or 18 to 20 minutes or 15 to 18 minutes. The period of drying will depend upon the conditions of drying. Additionally, the period of drying will depend upon the physical state of the previously applied layer necessary to carry out the objectives of the process of the invention.

The invention will further be illustrated in the following examples, it being understood that these examples are illustrative only and that the invention is not limited to the materials, conditions, process parameters and the like recited therein.

EXAMPLES

EXAMPLE 1

A 2% solution of Elvamide (polyamide from dupont ) is sprayed on an aluminum drum substrate to a thickness of 0.5 micrometers and dried to form a blocking layer prior to applying a charge generating layer.

A. Charge Generating Layer

A vanadyl phthalocyanine/polyester charge generating layer is prepared according to the following procedure. 22.5 grams of polyester- 100 (from dupont) is added to a mixture of 275 ml methylene chloride and 195 ml of 1,2-dichloroethane in a one liter container. The resulting mixture is placed on a roller mill for 90 minutes to mix thoroughly. 9.65 grams of vanadyl phthalocyanine are added to 160 ml of the above polyester/solvent mixture as are 150 grams of inch stainless steel shot in an 8 oz. glass jar. The mixture in the glass jar is placed on a paint shaker to run at alternate 15 minute periods for 3 hours. After the three hour period, the glass jar contents are poured into a one liter bottle and placed on a roller mill for 60 minutes. At the end of this period, the contents of the bottle are strained into a two liter bottle. The one liter bottle and stainless steel shot are rinsed with the remaining polyester solvent mixture and then with an additional 867 ml of methylene chloride and 600 ml of 1,2-dichlorethane which have been thoroughly mixed. The collected rinse is added to the 2 liter bottle, which is then placed on a roller mill for 60 minutes to thoroughly mix and obtain a fin&l solution. The final solution is spray coated to 1μ thickness on the previously prepared and dried polyamide layer. The freshly sprayed charge generating layer is allowed to set at ambient temperature for 10 minutes.

B. Charge Transport Layer

A charge transport layer comprising a mixture of meta-tolyl-bisdiphenylamino benzadine dispersed in a polycarbonate binder is prepared according to the following procedure. 1,854 ml of methylene chloride and 1,145 ml of 1,1,2-trichloroethane are combined in a one gallon amber jug (IUPILON Z-200, manufactured by Mitsubishi Gas Chemical Company, Inc.). 129.2 grams of polycarbonate are weighed on a single pan balance and added to the mixture in the amber jug. A screw cap is securely fastened on the jug, and the solution is mixed thoroughly and kept covered. To ensure complete mixing of the solution in the jug, the jug is placed on a roller mill for 90 minutes. The jug is removed from the roller mill and stored in a hood for 48 hours. 69.8 grams of meta-tolyl-bis-diphenylamino benzadine are weighed and added to the mixture in the jug. The screw cap is again securely fastened on the jug, the contents manually mixed and then again placed on a roller mill for 60 minutes. The resulting charge transport material composition is sprayed onto the undried charge generating layer to obtain a 20μ thick layer. The resulting charge transport layer is allowed to dry. The results of tests conducted on the imaging member are represented in Table I and the cross-sectional microstructure is illustrated in FIG. 1. The following parameters were used in evaluating the characteristics of the Example and Comparative Examples discussed herein.

$V_o$:

$V_0$ is the initial charge acceptance measurement. Voltage is observed 0.22 seconds after a charge of 100 nC/cm$^2$.

% DD:

The dark decay is expressed as a percentage of a voltage lost without exposure (in the dark) between 0.22 and 0.57 seconds after charging.

% Discharge

Photosensitivity is expressed as a percentage of voltage discharged by exposure to a fixed amount of light energy at a particular wavelength.

$V_{Contrast}$:

The voltage corresponding to percent discharge at a noted wavelength and exposure.

$V_e$:

The voltage remaining after exposure to approximately 300 ergs/cm$^2$ of a broad band (tungsten source) light.

COMPARATIVE EXAMPLE 1

An aluminum drum substrate is prepared in accordance with Example 1 except that after the charge generating material is spray coated to a 1μ thickness, the charge generating layer is dried for 10 minutes at 120° C. The test results conducted on the device are shown in Table I. The cross-sectional microstructure is shown in FIG. 3.

COMPARATIVE EXAMPLE 2

An aluminum drum substrate is prepared in accordance with Example 1 as is the charge generating layer. A charge transport solution is prepared by combining 1,854 ml of methylene chloride and 1,145 ml of 1,1,2-trichloroethylene in a one gallon amber jug. Sufficient polyether carbonate is added to the transport solution in the amber jug to obtain a 9.9% charge transport solution. A screw cap is securely fastened on the jug and the jug placed on a roller mill for 90 minutes to ensure complete mixing. The jug is removed from the roller mill and stored in a hood for 48 hours. A charge transport layer using the resulting transport solution is spray coated to achieve a 20μ thick layer. The resulting cross-sectional microstructure is shown in FIG. 3. Test results on the device are shown in Table T.

The device in Comparative Example 1 having a charge transport layer applied to a dried charge generating layer and representative of the prior art teachings exhibited decreased photoresponse as compared with the device of Example 1. Similarly, the device in Comparative Example 2, absent a charge transport material capable of migrating across the charge generating/charge transport interface, does not exhibit an increased photosensitivity as does the device in Example 1.

TABLE I

| Elec Props | Example 1 | Comparative Example 1 | Comparative Example 2 |
|---|---|---|---|
| $V_o$ | 876 | 926 | 783 |
| % DD | 2.1 | 1.0 | 1.5 |
| % Discharge* | 62 | 39 | 43 |
| $V_{Contrast}$** | 522 | 351 | 328 |
| $V_e$ | 25 | 35 | 12 |

*4.9 erg/cm$^2$, at 800 nm light.

**Measured at the same light energy and wavelength used to measure % Discharge.

What is claimed is:

1. A process for preparing an electrophotographic imaging member having a charge generating layer, a charge transport layer and an interphase region, said interphase region comprising a mixture of charge generating material and charge transport material between the charge generating layer and the charge transport layer, the process comprising: a) applying a charge generating material to form a wet underlying layer; b) prior to drying the underlying layer, overcoating a charge transport material onto the underlying layer to form a charge transport layer; and c) allowing charge transport material to diffuse into the wet underlying layer to form said interphase region.

2. The process according to claim 1, wherein:

d) the underlying layer and the charge transport layer are treated to fix the interphase region having a mixture of the charge generating material and the charge transport material.

3. A process for preparing an electrophotographic imaging member having a charge generating layer, a charge transport layer and an interphase region, comprising forming an interphase region comprising a mixture of charge generating material and charge transport material between the charge generating layer and the charge transport layer, wherein the charge generating material and the charge transport material are simultaneously applied to form the interphase region.

4. The process according to claim 3, wherein an amount of the charge generating material is decreased and an amount of the charge transport material is increased as the materials are simultaneously applied.

5. A process for preparing an electrophotographic imaging member having a charge generating layer, a charge transport layer and an interphase region, comprising forming an interphase region comprising a mixture of charge generating material and charge transport material between the charge generating material and the charge transport layer, wherein:

(a) the charge generating material is applied;

(b) a decreasing amount of charge generating material and an increasing amount of charge transport material are applied to form a gradient mixture of charge generating material and charge material in the interphase region; and (c) the charge transport material is applied.

6. The process according to claim 1, wherein at least one of the charge generating material and the charge transport material is dissolved in a solvent.

7. The process according to claim 6, wherein the solvent is selected from the group consisting of monochlorobenzene, tetrahydrofuran, cyclohexanone, methylene chloride, 1,1,1-trichloroethane, 1,1,2-trichloroethane, dichloroethylene, dichloroethane, toluene and mixtures thereof.

8. The process according to claim 6, wherein the charge generating material comprises a film-forming binder and a photogenerating pigment, and the film-forming binder, photogenerating pigment and solvent are selected from the group of combinations consisting of polyvinylbutyral, titanyl phthalocyanine and tetrahydrofuran; phenoxy resin, copper phthalocyanine and toluene; and polyester resin, vanadyl phthalocyanine and a mixture of methylene chloride and 1,2-dichloroethane.

9. The process according to claim 1, wherein the interphase region is formed by applying a material by spray coating, dip coating, roll coating, Meyer bar coating, bead coating or curtain flow coating.

10. The process according to claim 1, wherein the interphase region is formed by applying a material by dip coating.

11. The process according to claim 1, wherein b) the charge transport material is overcoated on the underlying layer by applying the charge transport material by spray coating, dip coating, roll coating, Meyer bar coating, bead coating or curtain flow coating.

12. The process according to claim 1, wherein b) the charge transport material is overcoated on the underlying layer by applying the charge transport material by dip coating.

13. The process according to claim 3, wherein the charge generating material and the charge transport material are simultaneously applied by spray coating, dip coating, roll coating, Meyer bar coating, bead coating or curtain flow coating.

14. The process according to claim 3, wherein the charge generating material and the charge transport material are simultaneously applied by dip coating.

15. The process according to claim 1, wherein a) the charge generating material is applied by spray coating, dip coating, roll coating, Meyer bar coating, bead coating or curtain flow coating.

16. The process according to claim 1, wherein a) the charge generating material is applied by dip coating.

17. The process according to claim 1, wherein a) the charge generating layer is applied and allowed to set at ambient temperature to form said wet underlying layer.

18. The process according to claim 17, wherein said charge generating layer is allowed to set at ambient temperature for about 10 minutes.

19. The process according to claim 1, wherein a) the charge generating material is applied by spray coating.

20. The process according to claim 1, comprising forming an interphase region comprising charge generating material and charge transport material mixed on a molecular level.

21. The process according to claim 1, wherein said charge transport layer comprises a charge transport material capable of migrating across said interphase region.

* * * * *